US007971272B2

(12) United States Patent
Bailey et al.

(10) Patent No.: US 7,971,272 B2
(45) Date of Patent: Jul. 5, 2011

(54) EXPANDABLE CHILDREN GARMENT WITH AN IMPROVED ADJUSTABLE FEATURE

(76) Inventors: Teresa Bailey, Brandywine, MD (US); Erin C. Bailey, Brandywine, MD (US); Ebony C. Bailey, Brandywine, MD (US)

( * ) Notice: Subject to any disclaimer, the term of this patent is extended or adjusted under 35 U.S.C. 154(b) by 151 days.

(21) Appl. No.: 12/457,009

(22) Filed: May 29, 2009

(65) Prior Publication Data

US 2010/0299802 A1 Dec. 2, 2010

(51) Int. Cl.
*A41D 10/00* (2006.01)
*A41D 27/10* (2006.01)

(52) U.S. Cl. ..... 2/80; 2/83; 2/79; 2/269

(58) Field of Classification Search ..... 2/69, 69.5, 2/79, 80, 83, 269
See application file for complete search history.

(56) References Cited

U.S. PATENT DOCUMENTS

| | | | | | |
|---|---|---|---|---|---|
| 461,434 | A | * | 10/1891 | Henry | 2/269 |
| 823,534 | A | * | 6/1906 | Hutchinson | 2/269 |
| 1,157,265 | A | * | 10/1915 | Tutelman | 2/269 |
| 2,153,068 | A | * | 4/1939 | Arden | 2/269 |
| 2,280,467 | A | * | 4/1942 | Blanc | 2/162 |
| 2,670,471 | A | | 3/1954 | Kaufman | |
| 2,675,554 | A | * | 4/1954 | Gertz | 2/80 |
| 2,687,530 | A | * | 8/1954 | Farnum | 2/217 |
| 2,705,326 | A | | 4/1955 | Lahnstein et al. | |
| 2,714,718 | A | | 8/1955 | Kramer | |
| 2,725,565 | A | * | 12/1955 | Wyner | 2/70 |
| 5,170,505 | A | | 12/1992 | Rohrer | |
| 5,299,323 | A | | 4/1994 | Schaefer et al. | |
| 5,367,709 | A | | 11/1994 | Teasley | |
| 5,539,932 | A | | 7/1996 | Howard | |
| 5,708,977 | A | | 1/1998 | Morkunas | |
| 6,058,508 | A | | 5/2000 | Brown Honeysuckle | |
| 6,223,352 | B1 | * | 5/2001 | Watlington | 2/80 |
| 6,317,894 | B1 | | 11/2001 | Blechman | |
| 6,339,847 | B1 | | 1/2002 | Hanks | |
| 6,654,968 | B2 | | 12/2003 | Braun et al. | |
| 6,684,407 | B2 | | 2/2004 | Crooks St. Pierre | |
| 6,792,622 | B2 | | 9/2004 | Graves | |
| 7,168,103 | B2 | | 1/2007 | Aldridge et al. | |
| 2003/0126667 | A1 | | 7/2003 | Braun et al. | |
| 2007/0266472 | A1 | | 11/2007 | DuFaux | |

* cited by examiner

*Primary Examiner* — Gloria Hale
(74) *Attorney, Agent, or Firm* — Patent Analysis Research Technology Sys. LLC; George L. Walton

(57) ABSTRACT

An adjustable garment includes an article of clothing and a plurality of unique adjustment features. The unique adjustment features includes a plurality of spaced apart pocket members and elastic band members disposed along sleeves, inseams and interior front and back portions of a shirt body portion, pants inseams, interior front and back pants leg portions, waist section of pants, interior portions of foot or bootie portions and associated extended body portions on one-piece garments. The spaced apart pocket members include a lower closed end and an upper open end with a fastener adjacent thereto. The elastic band having a first end cooperating with the lower closed end and a second end extending partially out of the open end with a plurality of fastener holes thereon. Adjustment of the garment is achieved by pulling the second end to connect a desired fastener hole with the pocket member fastener.

20 Claims, 12 Drawing Sheets

EXPANDABLE CHILDREN GARMENT WITH AN IMPROVED ADJUSTABLE FEATURE

CROSS REFERENCE TO RELATED APPLICATION(S)

None

BACKGROUND OF THE INVENTION

1. Field of the Invention

The present invention relates generally to garments and more particularly to children garments or clothing that is expandable or adjustable to accommodate for various growth or development stages of children. This invention more specifically relates to children garments or clothing, such as, sleepers, one-piece outfits with or without footed portions, body suits or rompers that are commonly worn by infants and young children with an expandable or adjustable feature. Also, the present invention relates to an article of clothing that includes shirts, blouses, pants, vests, coats, jackets, vests or other garment types.

2. Description of the Related Art

It is well known in the art to provide an adjustment feature for an article of clothing or garments particularly for infants and young children of novel construction, whereby the article of clothing or garments may be selectively lengthened or shortened, or made larger or smaller, as desired, to accommodate for the growth of an infant or young child.

According to one shortcoming of the prior art, clothing for infants and young children will typically be worn for a short period of time due to their rapid development and growth. This is especially true for seasonal clothing that typically can not be used by the same child the following season. For the most part these clothing articles generally are passed down to some other child in the home, in the community or given to charitable organizations for further use. This is because the life expectancy of clothing or garments worn by infants and young children are normally predicated upon the length of time the clothing will comfortably fit the infants and young children rather than the durability, flexibility and expandability of the clothing or garments.

Another shortcoming of the prior art is that infants and young children clothing are typically designated by sizes corresponding to their ages. As you know infants and young children vary in heights and sizes, even among infants and children of the same age. Such shortcoming has generated a need to provide infants and young children clothing or garments with adjustment means to accommodate for their various sizes and heights due to their growth or development. Such adjustment means allow consumers to reduce the cost of purchasing new clothing for infants and young children because of the rapid growth and development of infants and young children.

In children garments with a foot or boot portion or bootie, one of the major drawbacks is that children feet increase in size and the boot portion or bootie of a pant section becomes too small for infants and young children. Many times the upper body portion and the pant leg portions of children garments still fit comfortably, but the boot portion or bootie is too small and the garments have to be given away, thrown away or the boot portion or bootie has to be cut off, so that infants and young children can still use the garments. At other times, the entire garments become too small and can never be used again for that child or user. In another instant, a child's or user's foot size is too large for the boot portion or bootie, even though the child or user can fit the upper body and pant leg section. This boot portion becomes uncomfortable or too long for the child or user as they walk, causing tripping or the over sized boot portion can be caught in strollers, toys, wheels of scooters, tricycles, bicycles or other types of riding devices. This can cause very serious injuries to children and amass costly and unnecessary medical bills.

As a result of the above shortcomings, various types of adjustment features for infants and children clothing or garments have been developed. Some of these adjustment features can be found in the following prior art patents.

U.S. Pat. No. 2,670,471 teaches an adjustable feature in which children clothing or garments may be selectively adjusted to accommodate the size or growth of children in their development years, through the use of a plurality of tuck sections with respect to sleeves and stitched folds with respect to pant leg section for adjusting the children clothing or garments lengths, sizes and sleeves.

U.S. Pat. No. 2,705,326 teaches an adjustable feature in which children clothing or garments may be selectively adjusted to accommodate the size or growth of children in their development years, through the use of a plurality of fasteners and flaps on garment sleeves and foot portions for adjusting the children clothing or garments lengths, sizes and sleeves.

U.S. Pat. No. 2,714,718 teaches an adjustable feature in which children clothing or garments may be selectively adjusted to accommodate the size or growth of children in their development years, through the use of a plurality of buttons and button holes for adjusting the children clothing or garments lengths, sizes and sleeves.

U.S. Pat. No. 5,170,505 teaches an adjustable feature in which children clothing or garments may be selectively adjusted to accommodate the size or growth of children in their development years, through the use of a plurality of loop and hook fasteners panels buttons and button holes for adjusting various panels of the children clothing or garments. U.S. Pat. No. 5,367,709 teaches an adjustable feature in which one-piece children clothing or garments may be selectively adjusted to accommodate the size or growth of children in their development years, through the use of a closed sleeves and drawstrings therein and positioned along the garments' side seams for adjusting the children clothing or garments lengths and sizes.

U.S. Pat. No. 5,708,977 teaches an adjustable feature in which one-piece children clothing or garments may be selectively adjusted to accommodate the size or growth of children in their development years, through the use of a plurality of fasteners of various types for allowing an expansion unit to contract or expand as needed for adjusting the children clothing or garments lengths and sizes.

U.S. Pat. No. 6,058,508 teaches an adjustable feature in which children clothing or garments may be selectively adjusted to accommodate the size or growth of children in their development years, through the use of a plurality of fasteners and zipper means for adjusting the children clothing or garments lengths and sizes.

U.S. Pat. No. 6,339,847 teaches an adjustable feature in which one-piece children clothing or garments may be selectively adjusted to accommodate the size or growth of children in their development years, through the use of boot portions of pant leg portions and elastic bands or draw strings to be tied about the wearer's ankle for adjusting the children clothing or garments lengths, sizes and preventing the wearer's foot from sliding in and out of the boot portion or bootie.

U.S. Patent Publication No. 2007/0266472 teaches an adjustable feature in which children clothing or garments may be selectively adjusted to accommodate the size or growth of children in their development years, through the use of a plurality of different types fasteners on upper body portions, leg portions and boot portions or booties for adjusting children clothing or garments lengths and sizes.

Although these prior art devices might be creative, and well-though-out inventions, that function well for their intended purpose at the time of their creation, but some, if not all, are cumbersome and timely to adjust, unpleasing appearance, unnecessary fabric or material gathering and limited flexibility as the children clothing or garments are adjusted either by contracting or expanded.

However, the present invention overcomes all of the above shortcomings and provides a unique adjustment feature which is versatile and easy to use, inexpensive to incorporate into any type of garment utilized for infants, children or adults, provides for comfort when in use and maintains an aesthetically pleasing appearance when the children clothing or garments are selectively adjusted, contracted or expanded.

SUMMARY OF THE INVENTION

An improved adjustable garment according to one of the preferred embodiments of the present invention includes an improved and unique adjustment feature or element sewn or attached to an interior portion of a body portion, leg portion and sleeve portion of infants and children clothing or garments to selectively adjust and accommodate the length and size of infants and children clothing and garments during their development and growth stages. The garment is a one-piece article of clothing, such as a sleeper, with an upper shirt body portion having a collar with a first wearer entry opening with a pair of parting sections with a plurality of snap fasteners on each section extending from the collar to a selected location on the upper shirt body portion to allow the garment to be placed easily over the head of the user, a pair of sleeves, a pair of pant leg portions and a foot or boot portion or bootie attached to the leg portions of the one-piece garment. Also, the leg portions have a second pair of entry parting sections extending from the crotch area down the leg portions to the foot or boot portion or bootie with a plurality of snap fasteners on each entry parting sections for easy access in putting on and taking off the one-piece garment. Optionally, the first and second wearer entry openings could be a single wearer entry opening with a pair of parting sections with a plurality of fasteners on each parting sections extending from the collar down the leg portions to the foot or boot portion or bootie easy access in putting on and taking off of the garment. It is to be noted that the different wearer entry openings could be positioned either along the front or the back of the one-piece garment, if desired. Note that the sleeves are illustrated as both short and long in the drawings of the present invention. The long sleeves have stretchable cuffs at their respective ends thereof. Further, the unique adjustment feature includes a first plurality of spaced apart pockets sewn or attached to and along an interior portion with a button element attached to and adjacent upper open ends of the pockets opposite lower sewn or attached ends. The plurality of spaced pockets having lower ends that are secured from and adjacent the open ends of the pair of sleeves opposite the upper ends that are attached to the shoulder sections at a selected distance to a desired location extending along the pair of sleeves and being spaced from the open ends attached to the shoulder sections.

Also, the unique adjustment feature or element further includes a second pair of pockets sewn and attached along the front interior pant leg portions, along an upper inside portion of the foot or boot portions or booties with a lower end extending and being sewn or attached to or adjacent the toe portions of the foot or boot portions or booties. An upper open end of the pockets is sewn and attached at selected distance to a desired location on the interior of the front pant leg portions with a button element attached to and adjacent the upper open ends of the pockets opposite the lower sewn or attached ends. Further, the unique adjustment feature further includes a third pair of pockets sewn and attached along the back interior pant leg portions, along a lower inside portion of the foot or boot portions or booties with a lower end extending and being sewn and attached to or adjacent the toe portions of the foot or boot portions or booties. An upper open end of the pockets is sewn and attached at a selected distance to a specific location on the interior of the pant leg portions with a button element attached to and adjacent the upper open ends of the pockets opposite the lower sewn or attached ends.

The plurality of first, second and third pockets as discussed above, further includes an adjustable elastic band or stretchable member with a plurality of space apart button holes that selectively receives the button members as the adjustable elastic band or stretchable members are stretched to a desired button hole position for adjusting infants and children clothing or garments to accommodate various lengths and sizes of infants and children as they grow. An upper end of each of the elastic band or stretchable members extends outwardly of the plurality of first, second and third pockets open ends, with the lower end of the elastic band or stretchable members being sewn or attached to the lower ends of the plurality of pockets. This enables each of the elastic band or stretchable members to be selectively pulled and stretched out of the open ends of the plurality of pockets to connect any of the desired button holes with the plurality of pocket button members to accommodate for infants or children growth or physical dimensional changes in their bodies, while at the same time reducing or eliminating material gathering as the infants or children clothing or garments are adjusted.

According to a second preferred embodiment, an improved adjustable garment of the present invention includes an unique adjustment feature or element being sewn or attached to an interior portion of a body portion adjacent to or along the seams thereof, the waist section of the pant or trouser portion, the pant leg portions of the pant or trouser portion and the sleeves of the shirt body portion of infants and children clothing or garments for selectively adjusting and accommodating the length and size of infants and children clothing or garments during their development and growth stages. The article of clothing or garment of the second preferred embodiment is a detachable three-piece article of clothing with an upper shirt body portion with a pair of sleeves, a detachable pant or trouser portion with a pair of pant leg portions and a foot or boot portion or bootie removably attached to each of the pant leg portions of the detachable pant or trouser portion. Note that the sleeves can be both short and long as depicted in the drawings of the present invention. The long sleeves have stretchable cuffs at their respective ends thereof. The garment utilizes the same adjustment features in the same manner as discussed above in the first embodiment with some modifications. This embodiment includes additional and similar fourth and fifth adjustment features. Note that the second adjustment feature is not a one-piece member as described in the first preferred embodiment; it is divided into plural sections in the second preferred embodiment. The modifications will now be discussed in greater details below.

In the second preferred embodiment, the unique and improved second adjustment feature or element further includes a second pair of pockets that are divided into first and second separate parts. In the first separate part, a pair of pockets are sewn or attached along the pair of front interior pant leg portions extending between lower open ends of the pant leg portions to desired spaced locations thereon. At or near the lower open ends of the pant leg portions, a plurality of spaced apart fasteners is disposed about the circumference thereof. The second separate part includes a pair of pockets that are sewn or attached along an inside portion along the back section, the heel section and the bottom foot section of a pair of foot or boot portions or booties with a lower end extending to and being sewn or attached to or adjacent the toe portion of each of the foot or boot portion or bootie. The pockets having upper open ends that are sewn or attached at a selected distance to a desired location on the interior of the front pant leg portions and on the back section of the pair of foot or boot portions or booties with a button element attached to and adjacent the upper open ends of the pockets opposite the lower sewn or attached ends. Optionally, the foot or boot portions or booties in the second preferred embodiment could have at least a pair of improved adjustment feature being attached and positioned along each side of the foot or boot portions or booties extending from or adjacent the toe portion to a spaced distance at or near the back or heel portion thereof in the same manner as described above.

At or near upper open ends of the pair of foot or boot portions or booties, a plurality of spaced apart fasteners is disposed about the circumference thereof for detachably receiving or engaging the plurality of spaced apart fasteners of the pant leg portions to create a unitary pant or trouser portion and foot or boot portion or bootie clothing article or garment or the flexibility to enable the detachment of the pant or trouser portion from the foot or boot portion or bootie to be used separately or the versatility of using the same or different types of foot or boot portion or booties with the same or different types of pant or trouser portions. This feature allows one to match-up different types of clothing or garment outfits, different color coordination and the prolonging of user wear, which will aid in reducing cost in purchasing new and multiple types of children clothing or garments.

Also, the waist section of the pant or trouser portion includes a unique and improved fourth adjustment feature. This fourth adjustment feature or element includes at least a pair of spaced apart pockets that are sewn or attached along an interior front portion of the waist section with a lower closed end being secured at or adjacent to the side seams of the pant or trouser portion and an upper open end being secured at a selected and spaced location on the interior front portion thereof. If desired, a second pair of adjustments pockets can be disposed along the interior back portion of the waist section and secured in the same manner as the pair of pockets disposed on the interior front portion.

The shirt body portion with the pair of sleeves of the three-piece garment of the second embodiment includes a fifth adjustment feature or element having at least a pair of spaced apart pockets that are preferably sewn or attached along the inside side seams of the shirt body portion and positioned at a selected and spaced distance along the interior side seams. Optionally, the at least a pair of spaced apart pockets could be sewn or attached along the interior front portion of the shirt body portion at or adjacent the inside side seams with a lower closed end being secured at or adjacent to the lower open end of the shirt body portion and an upper open end extending to a selected and spaced distance along the interior front portion of the shirt body portion at or adjacent the inside side seams. Also, at least another pair of spaced apart pockets could be sewn or attached along the interior back portion of the shirt body portion at or adjacent the inside side seams with a lower closed end being secured at or adjacent to the lower open end of the shirt body portion and an upper open end extending to a selected and spaced distance along the interior back portion of the shirt body portion at or adjacent the inside side seams, if desired. The upper open end of the pockets has a button member attached to and adjacent the upper open ends of the pockets opposite the lower sewn or attached ends.

The plurality of second, fourth and fifth pockets of the second preferred embodiment as discussed above, further includes an adjustable elastic band or stretchable member with a plurality of spaced apart button holes that selectively receives the button members as the adjustable elastic band or stretchable members are stretched to a desired button hole position for adjusting infants and children clothing or garments to accommodate various lengths and sizes of infants and children as they grow. An upper end of the elastic band or stretchable member extends outwardly of the plurality of second, fourth and fifth pockets open ends, with the lower end of the elastic band or stretchable member being sewn or attached to the lower ends of the plurality of pockets. This enables each of the elastic band or stretchable members to be selectively pulled and stretched out of the open ends of the plurality of pockets to connect any of the desired button holes with the plurality of pocket button members to accommodate for infants or children growth or development stages, while at the same time reducing or eliminating material gathering as the infants and children clothing or garments are adjusted.

According to a third embodiment of the present invention, another one-piece garment type for infants and children such as a romper type outfit having a pair of short or long sleeves, a shirt body portion with a front section and a back section and an extension or flap member that extends from the back section beyond the front section defining an opening to receive the legs and crotch area of an infant or child. At the lower end of the front section at least a first pair of spaced apart fasteners is disposed thereon and at a lower end of the extension or flap member has at least a second pair of mating fasteners. When the first and second pairs of mating fasteners are snapped together around the legs and crotch of the user or child, a pair of openings for the legs are formed and fit snugly and comfortably thereabout. This one-piece infant or children garment includes the aforementioned improved and unique adjustment feature sewn or attached to an interior portion of a body portion, and sleeve portions of infants and children clothing or garments to selectively adjust and accommodate the length and size of infants and children clothing and garments during their development and growth stages.

The shirt body portion with the pair of sleeves of the one-piece garment of the third embodiment includes a sixth adjustment feature having at least a pair of spaced apart pockets that are preferably sewn or attached along the inside side seams of the shirt body portion and positioned at a selected and spaced distance along the interior side seams in the same manner as previously discussed in the second preferred embodiment. Optionally, the at least a pair of spaced apart pockets could be sewn or attached along the interior front portion of the shirt body portion at or adjacent the inside side seams with a lower closed end being secured at or adjacent to the lower open end of the shirt body portion and an upper open end extending to a selected and spaced distance along the interior front portion of the shirt body portion at or adjacent the inside side seams as previously discussed. Also, at least another pair of spaced apart pockets could be sewn or attached along the interior back section of the shirt body portion at or adjacent the inside side seams with a lower closed end being secured at or adjacent to the lower open end of the shirt body portion and an upper open end extending to a selected and spaced distance along the interior back section of the shirt body portion at or adjacent the inside side seams, if desired, in the same manner as previously discussed in the second preferred embodiment. The upper open end of the pockets has a button member attached to and adjacent the upper open ends of the pockets opposite the lower sewn or attached ends.

The plurality of pockets of the third preferred embodiment as discussed above, further includes an adjustable elastic band or stretchable member with a plurality of spaced apart button holes that selectively receives the button members as the adjustable elastic band or stretchable members are stretched to a desired button hole position for adjusting infants and children clothing or garments to accommodate various lengths and sizes of infants and children as they grow. An upper end of the elastic band or stretchable member extends outwardly of the plurality of second, fourth and fifth pockets open ends, with the lower end of the elastic band or stretchable member being sewn or attached to the lower ends of the plurality of pockets. This enables each of the elastic band or stretchable members to be selectively pulled and stretched out of the open ends of the plurality of pockets to connect the any of the desired button holes with the plurality of pocket button members to accommodate for infants or children growth or development stages and simultaneously reducing or eliminating material gathering as the infants and children clothing or garments are adjusted.

As an option, the front of the extension or flap member could include a pocket and elastic band member adjustment feature that has its lower closed end attached at or adjacent the fasteners thereon and the upper open end being attached at a spaced and selected distance along the extension or flap member, if desired.

The sleeves of the one-piece garment of the third embodiment includes the same at least a pair of the adjustment pockets and elastic band member adjustment feature in the same manner as described above in the first and second preferred embodiments of the present invention.

Preferably, the fasteners on the wearer entry openings, the button member and the plural button holes fastener for the pocket and elastic band member, the fasteners on the foot or boot portion or bootie and the pant or trouser portion and the fasteners on the one-piece garment with the extension or flap member can take on various other types of fasteners. This includes buttons, zippers, hook-and-loop type materials (e.g. Velcro), snaps including metallic or plastic snaps, magnets, or any other mechanism that may be used to conveniently attach and detach sections of clothing from each other. Note that the fasteners may have matching cloth material covering them to match the material of the children clothing or garments.

The pocket and elastic band member adjustment features of the present invention can be utilized with an article of clothing or garments that includes romper or one-piece outfits, multiple piece outfits, shirts, blouses, dresses, pants or trousers, bibs, vests, coats, jackets, gowns, lingerie (all apparel types), hospital garments, maternity garments, uniforms or other types of clothing or garments. Also, the pocket and elastic band member adjustment feature of the present invention can be utilized with belts and shoes, if desired.

Optionally, a typical elastic or stretchable waist band could be utilized in the present invention, that is well known in prior art.

Also, a preventive type of material could be utilized on the bottom of the foot or boot portions or booties of the first and second preferred embodiments of the present invention to prevent slippage and sliding as children walk along slippery surfaces, such as hardwood, tile, brick, linoleum, marble or vinyl floors, etc.

In accordance with a still further aspect of the present invention, the article of clothing or children garments could typically, although not necessarily, be children sleeping wear. Also, the type of material that the children garments are made out of could be the same soft and elastic sleeping garment materials used to make existing pajamas, if desired. However, any type of clothing material could be used to make the children clothing or garments. Preferably, materials such as cotton, polyester, acrylic textile, rayon, silk, satin, linen, terry cloth, jean, leather or any combination thereof, to name just a few, are some of the materials of preferred interest that is well known in the art.

BRIEF DESCRIPTION OF THE DRAWINGS

The present invention may be better understood, along with its numerous objects, features, and advantages made apparent to those skilled in the art by referencing the accompanying drawings.

DETAILED DESCRIPTION

Reference will now be made in detail to the preferred embodiments of the invention, examples of which are illustrated in the accompanying drawings. While the invention will be described in conjunction with the accompanying drawings, it will be understood that they are not intended to limit the invention to drawings. On the contrary, the present invention is intended to cover alternatives, modifications and equivalents, which may be included within the spirit and scope of the invention as defined by the appended claims.

Figure 1:
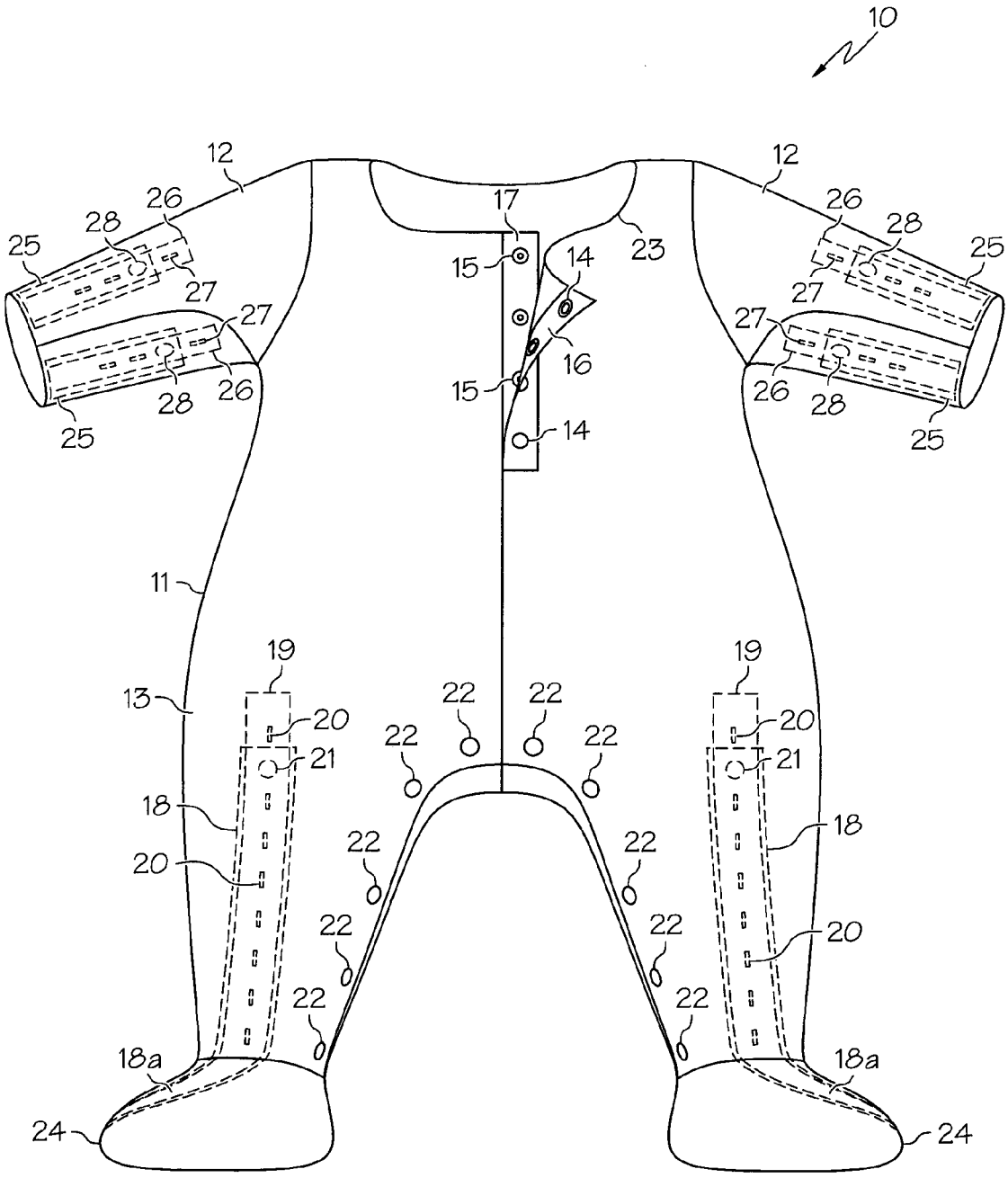
FIG. 1 is a perspective front view of a one-piece children garment with a foot or boot portion or bootie with an improved and unique adjustment feature having adjustable pockets and elastic band members according to a first preferred embodiment of the present invention.

FIG. 1 is a perspective front view of an adjustable one-piece article of clothing or children garment 10 constructed according to the teachings of the present invention. The adjustable garment 10 includes an upper shirt body portion 11, with a pair of short sleeves 12 with the improved and unique adjustment feature that will be described in greater detail later, a collar portion 12 defining a wearer or user entry opening with a first parting section 16 with a plurality of snap type fasteners 14 and a second parting section 17 with a plurality of mating fasteners 15 thereon, extending from the collar to a selected location on the front of the upper shirt body portion that allows the adjustable garment 10 to be placed easily over the head of the user or wearer so that it can be worn, and a pair of leg portions 13 having a pair of foot or boot portions or booties 24 with the improved and unique adjustment feature thereon to be discussed in greater detail later, the leg portions 13 includes a pair of entry parting sections extending from the crotch area of the one-piece adjustable garment 10 down the leg portions to the foot or boot portion or bootie with a plurality of snap fasteners 22 on each entry parting sections for easy access in putting on and taking off the adjustable one-piece garment 10.

In the preferred embodiment illustrated in FIG. 1, the adjustable garment 10 is an infant or children sleeper outfit. However, other types of clothing articles may also be used for adjustable garment 10, such as, romper outfits, multiple piece outfits, shirts, blouses, dresses, pants or trousers, bibs, vests, coats, jackets, gowns, lingerie (all apparel types), hospital garments, maternity garments, uniforms or other types of clothing or garments. The teachings of the present invention that relates to the unique and improved adjustment feature will be further described in conjunction with FIGS. 2-13 as to how it works and how it is incorporated into other types of clothing garments for selectively adjusting and accommodating the length and size of infants and children clothing and garments during their development and growth stages.

As illustrated in FIG. 1, the unique and improved adjustment feature will now be described. The primary objective is to be able to adjust various types of clothing articles or garments, while at the same time, reducing or eliminating material gathering as the infants and children clothing or garments are adjusted to accommodate growth changes in infants or children, in order to maintain the garment's integrity.

The aforementioned unique and improved adjustment feature includes a first plurality of spaced apart pockets 25 that are sewn or attached to and along an interior portion of the sleeves 12 with a button member 28 attached to and adjacent the upper open ends of the pockets opposite the lower sewn or attached ends. The plurality of spaced pockets 25 having lower ends that are secured from and adjacent the open ends of the pair of sleeves 12 opposite the upper ends that are attached to the shoulder sections at a selected distance to a desired location extending along the pair of sleeves 12 and being spaced from the open ends attached to the shoulder sections.

Also, the unique adjustment feature further includes a second pair of pockets 18 that is sewn and attached along front interior pant leg portions 13, along an upper inside portion 18*a* of the foot or boot portions or booties with a lower end extending and being sewn or attached to or adjacent the toe portions of the foot or boot portions or booties. An upper open end of the pockets 18 is sewn and attached at selected distance to a desired location on the interior of the front pant leg portions with a button member 21 attached to and adjacent the upper open ends of the pockets 18 opposite the lower sewn or attached ends.

Optionally, a typical elastic or stretchable waist band could be utilized at or near a waist section along the back or rear body portion 11 of the first preferred embodiment of the present invention, that is well known in prior art, if desired.

Figure 2:
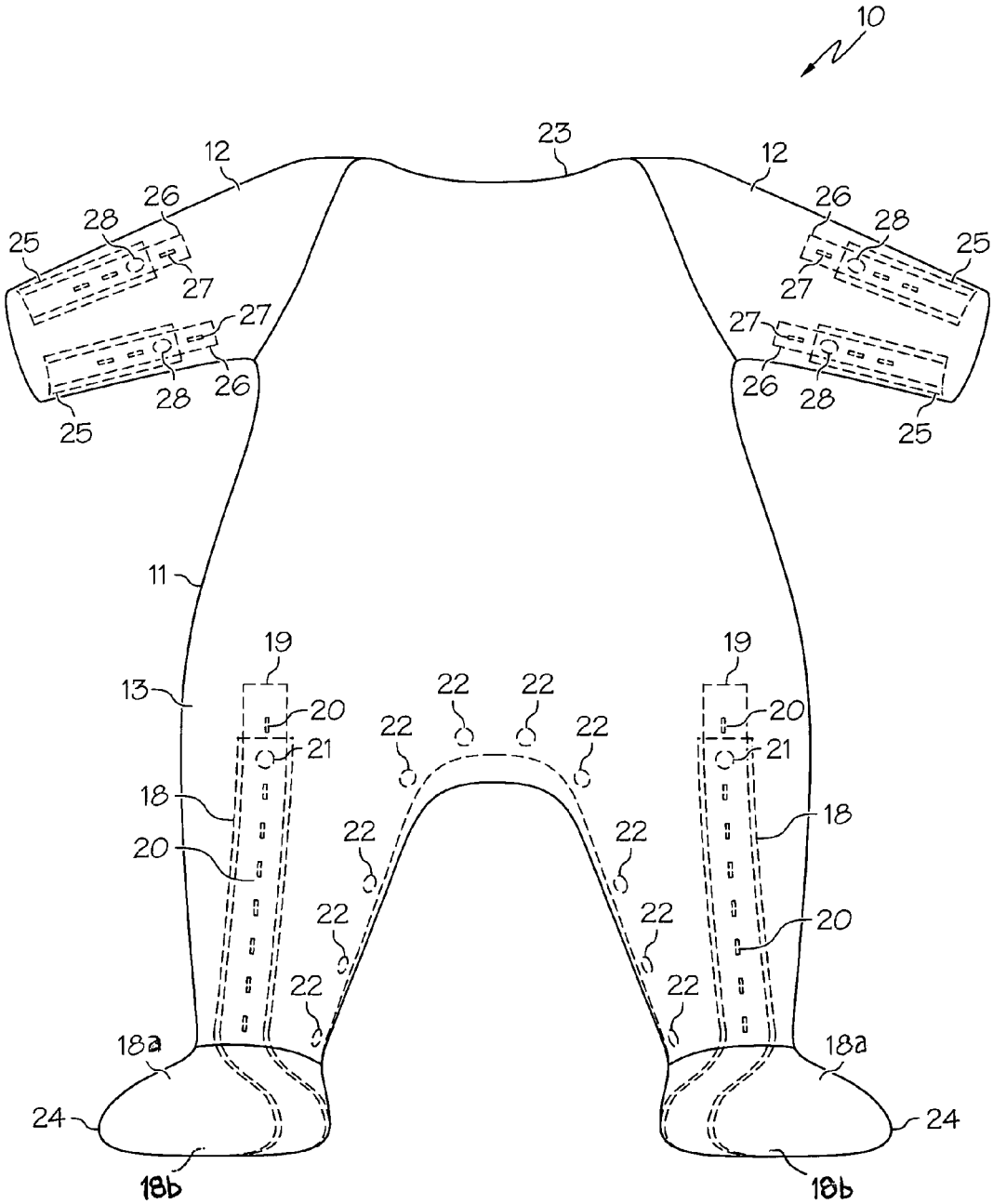
FIG. 2 is a perspective rear view of a one-piece children garment with a foot or boot portion or bootie with an improved and unique adjustment feature having adjustable pockets and elastic band according to a first preferred embodiment of the present invention.

As illustrated in FIG. 2, the unique adjustment feature further includes a third pair of pockets 18 that is sewn or attached along the back interior pant leg portions, along the heel portion and to a lower bottom portion 18*b* of the foot or boot portions or booties 24 with a lower end extending and being sewn or attached to or adjacent the heel portion or toe portion of the foot or boot portions or booties 24. An upper open end of the pockets 18 is sewn or attached at a selected distance to a desired location on the interior of the pant leg portions 13 with a button member 21 attached to and adjacent the upper open ends of the pockets 18 opposite the lower sewn or attached ends.

The plurality of first pockets 25 of sleeves 12 as illustrated in FIGS. 1 and 2, further includes an adjustable elastic band or stretchable member 26 with a plurality of space apart button holes 27 that selectively receives the button member 28 as the adjustable elastic band or stretchable member 26 is stretched to a desired button hole 27 position for adjusting infants and children clothing or garment 10 to accommodate various lengths and sizes of infants and children as they grow. An upper end of the elastic band or stretchable member 26 extends outwardly of the plurality of first pockets 25 open ends, with the lower end of the elastic band or stretchable member being sewn or attached to the lower ends of the plurality of pockets 25. This enables the elastic band or stretchable member 26 to be selectively pulled and stretched out of the open ends of the plurality of pockets 25 to connect the desired button holes 27 with the plurality of pocket button members 28 to reduce or eliminate material gathering as the infants and children clothing or garment 10 is adjusted to accommodate for infants or children growth or development.

The second and third pockets 18 as shown in FIGS. 1 and 2 further include the same elastic bands or stretchable members 19, the plurality of spaced apart button holes 20 and the plurality of button members 21 as discussed above. In order to adjust garment 10, the elastic band or stretchable members 19 are selectively pulled and stretched out of the open ends of the plurality of pockets 18 in order to connect one of the desired button holes 27 with one of the selected plurality of pocket button members 28 to expand or contract the garment 10 to accommodate the physical change in size and length of infants and children, while at the same time, reducing or eliminating material gathering as the infants and children clothing or garment 10 is adjusted. By the pockets 18 and elastic band members 19 being on the interior of the garment 10, the aesthetic appearance and the material integrity is always maintained.

Figure 3:
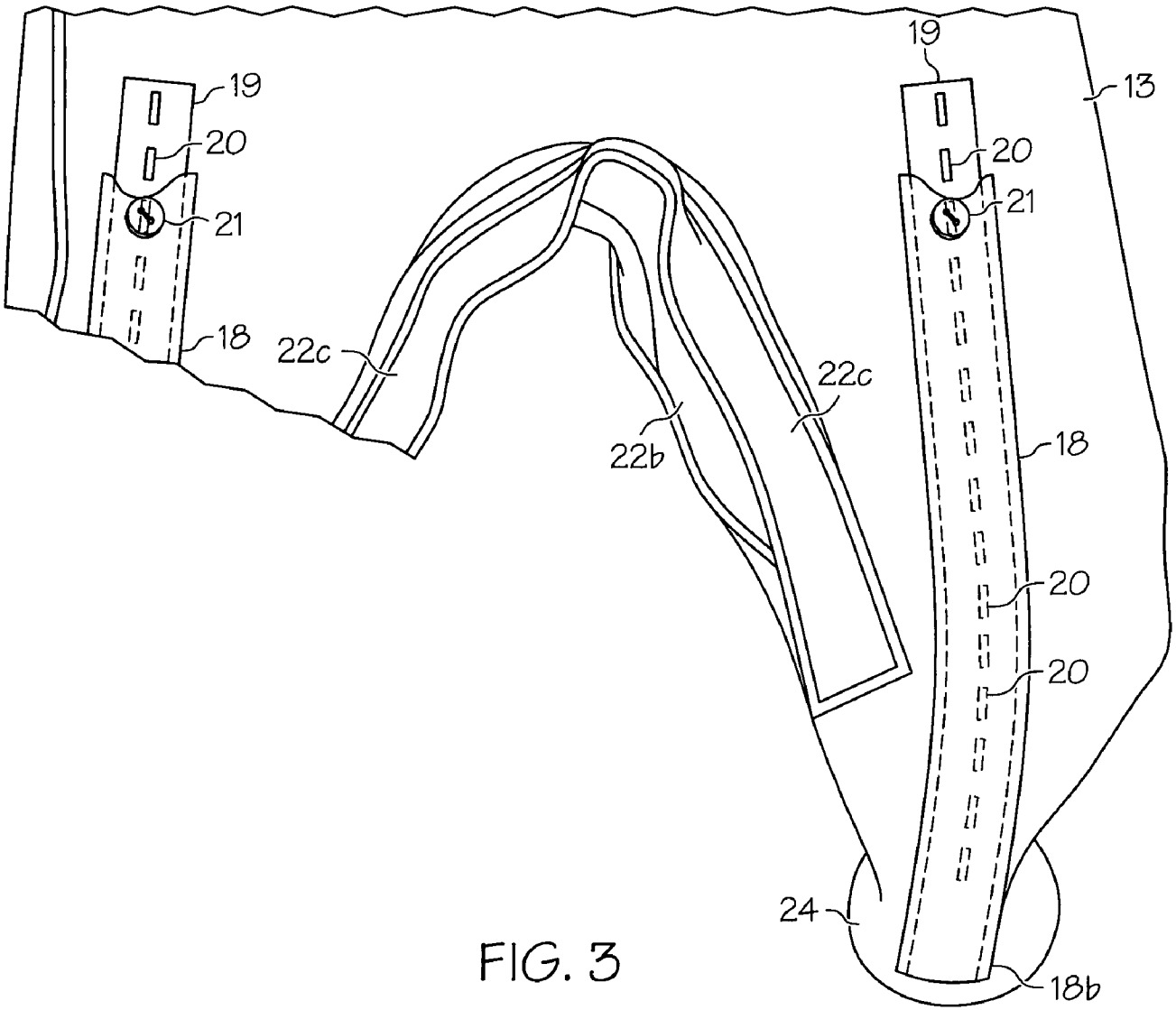
FIG. 3 is a cross sectional inside out view of the improved and unique adjustable pockets and elastic band member adjustment feature disposed along the rear leg portion according to the first preferred embodiment of the present invention.

FIG. 3 illustrates a cross sectional inside out cut-out view of the improved and unique adjustable pockets 18, the elastic band members 19, the plurality of spaced apart button holes 20 and the plurality of button members 21 disposed along the rear or back leg portion 13 according to the first preferred embodiment of the present invention. This view enables one to see exactly what the adjustable pockets 18 and elastic band or stretchable members 19 look like and how they are attached. As previously discussed, the leg portions 13 entry parting sections that extend from the crotch area of the one-piece adjustable garment 10 down the leg portions to the foot or boot portion or bootie with the plurality of snap fasteners 22 on each entry parting sections for easy access in putting on and taking off the adjustable one-piece garment 10. The parting sections are defined by the first section 22*b* and the second section 22*c*.

Figure 4:
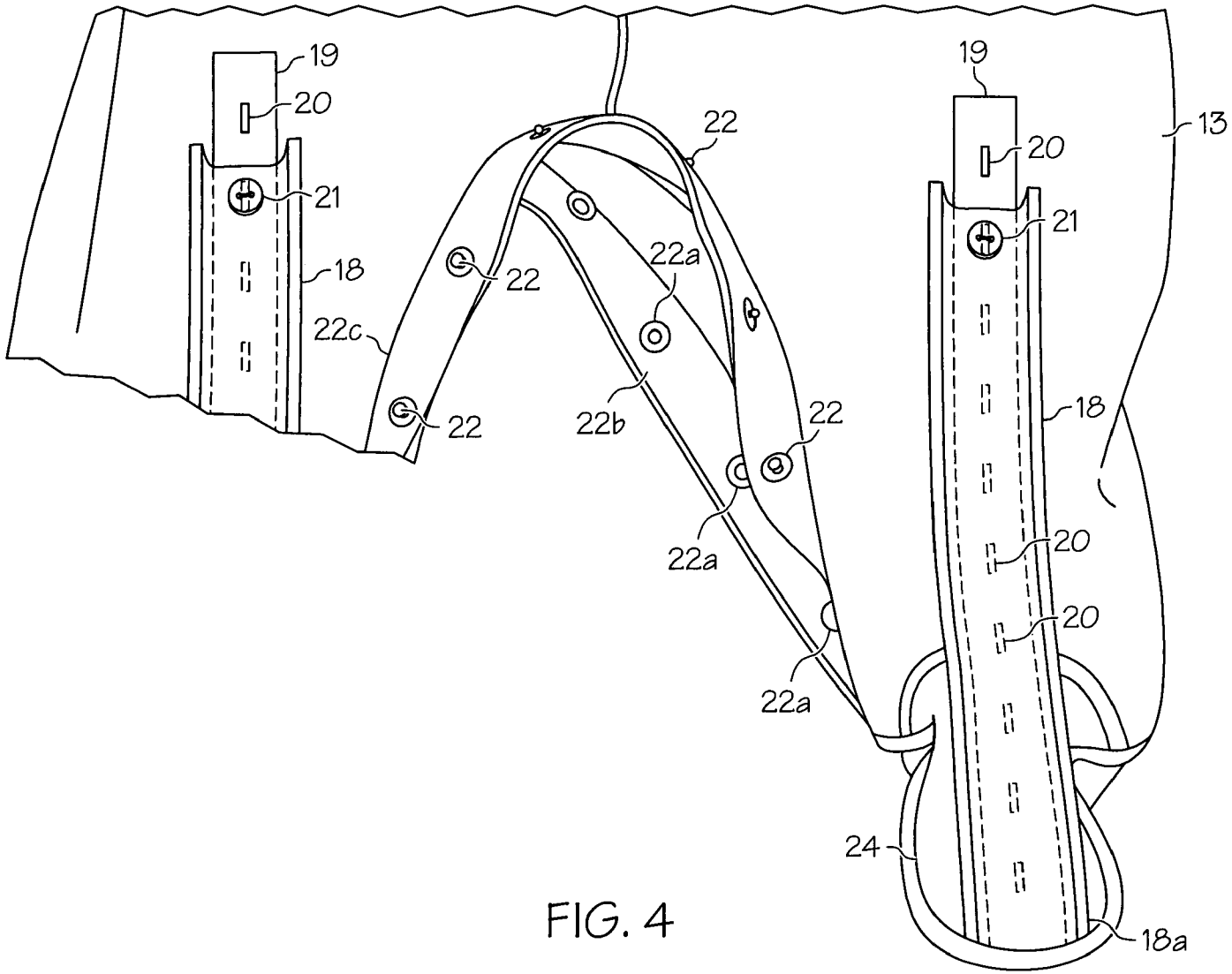
FIG. 4 is a cross sectional inside out view of the improved and unique adjustable pockets and elastic band member adjustment feature disposed along the front leg portion according to the first preferred embodiment of the present invention.

FIG. 4 is a cross sectional inside out cut-out view of the improved and unique adjustable pockets and elastic band member adjustment feature disposed along the front leg portion according to the first preferred embodiment of the present invention. This view is the same as the view discussed above in FIG. 3 with the following difference. The first parting section 22*b* and the second parting section 22*c*. The first parting section 22*b* has a first plurality of snap fasteners and the second parting section 22*c* has a second plurality of mating snap fasteners 22 for separating and closing the leg portions 13 for easy access in putting on and taking off the adjustable one-piece garment 10. Note that different types of fasteners could be utilized, such as, buttons and button holes, zippers, Velcro-type materials, metallic or plastic snaps, magnets, or any other mechanism that may be used to conveniently attach and detach sections of clothing from each other.

Figure 5:
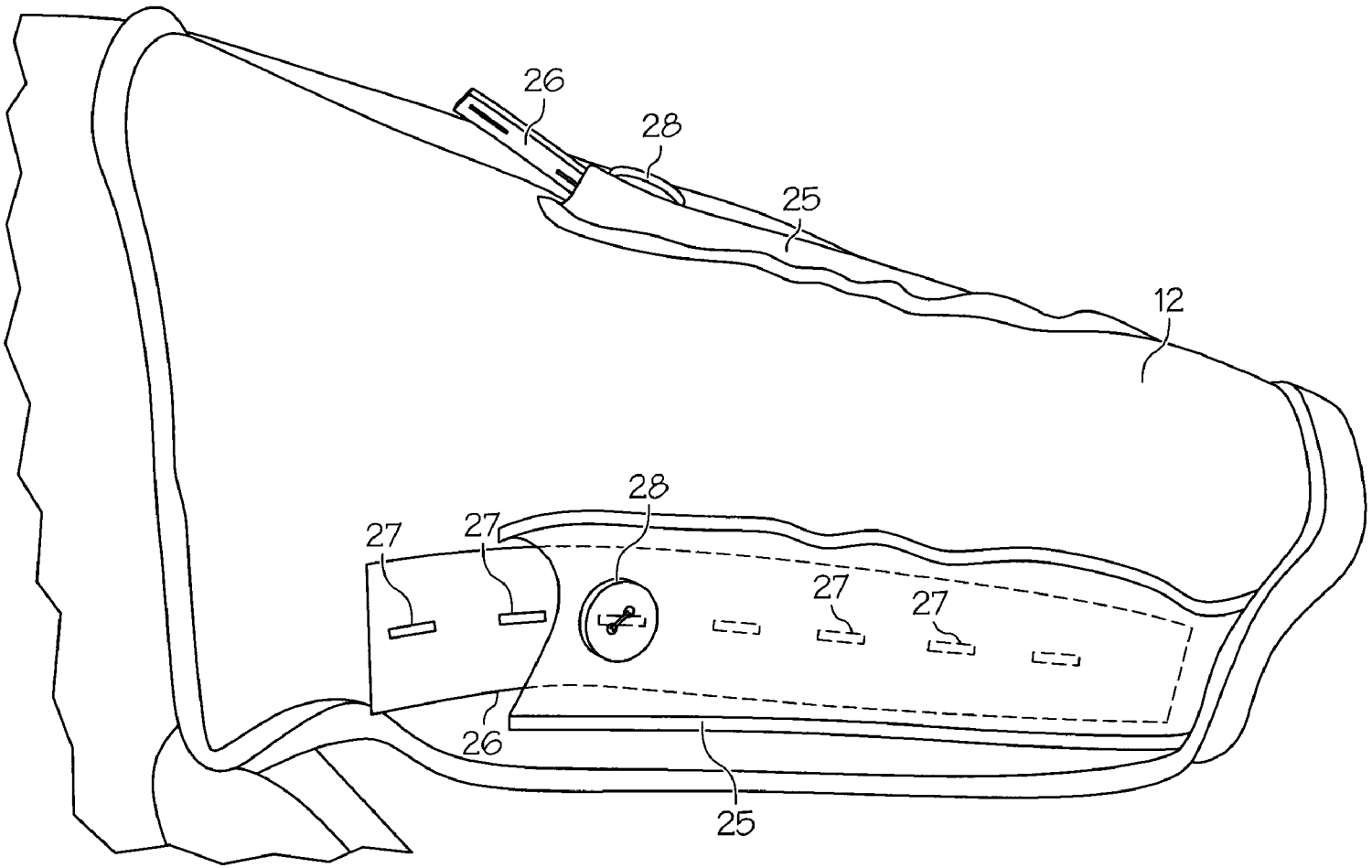
FIG. 5 is a cross sectional inside out view of at least a pair of the improved and unique adjustable pockets and elastic band members disposed along the sleeve portion according to the first preferred embodiment of the present invention.

FIG. 5 is a cross sectional inside out cut-out view of at least a pair of the improved and unique adjustable pockets 25 with button fastening member 28 and the elastic band members 26 with the fastening button holes 27 disposed along and spaced about the sleeve portion 12 according to the first preferred embodiment of the present invention. This view clearly shows what the pockets 25 and the elastic band or stretchable member 26 looks like and how the pockets 25 and the elastic band or stretchable member 26 are attached to the interior of the sleeve portion 12.

Figure 6:
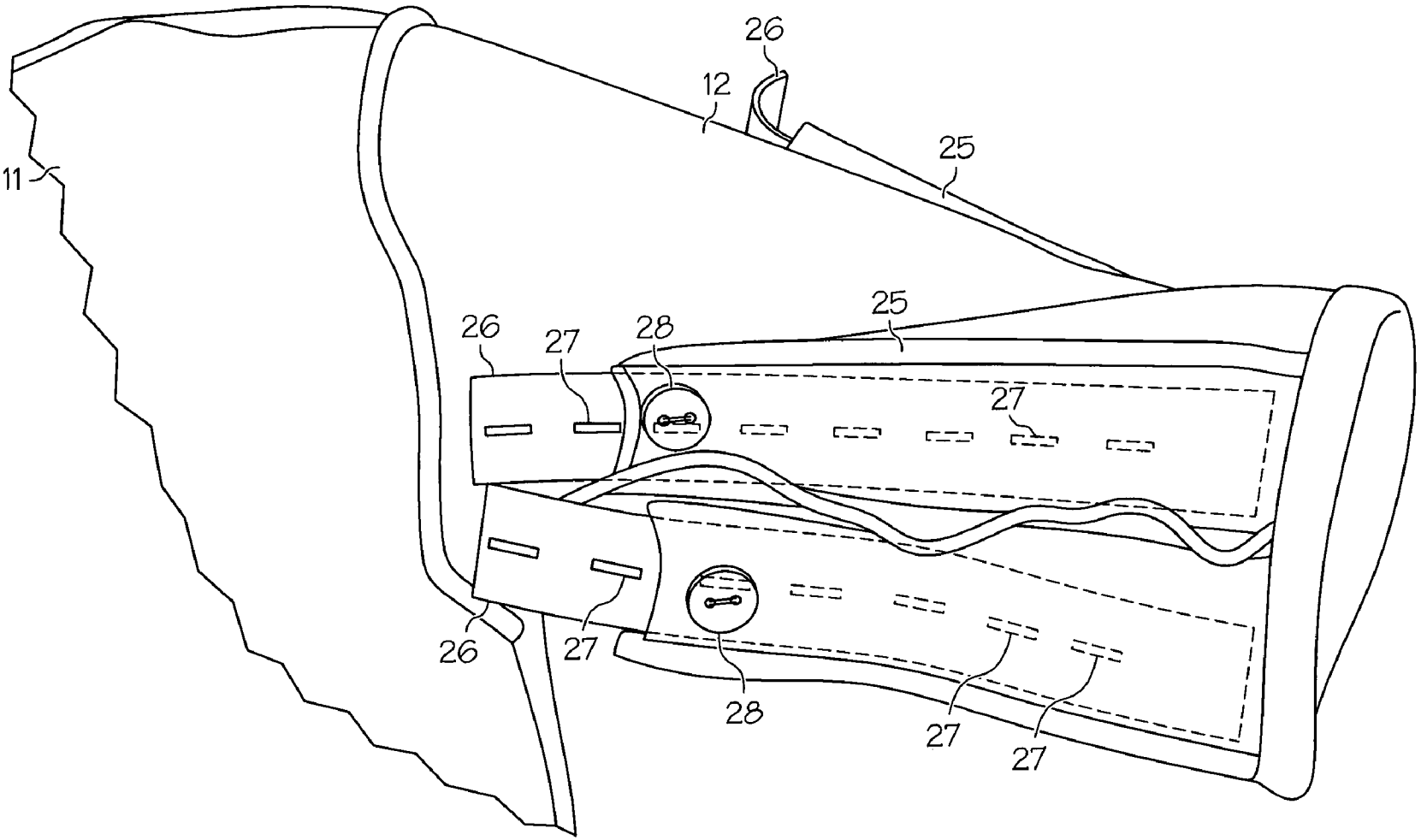
FIG. 6 is a cross sectional inside out view of at least a three of the improved and unique adjustable pockets and elastic band members disposed along the sleeve portion according to the first preferred embodiment of the present invention.

FIG. 6 is a cross sectional inside out cut-out view that shows at least three of the improved and unique adjustable pockets 25 with button fastening member 28 and the elastic band or stretchable members 26 with the fastening button holes 27 disposed along and spaced about the sleeve portion 12 according to the first preferred embodiment of the present invention. Also, this view clearly shows what the pockets 25 and the elastic band or stretchable member 26 looks like and how the pockets 25 and the elastic band or stretchable member 26 are attached to the interior of the sleeve portion 12.

Figure 7:
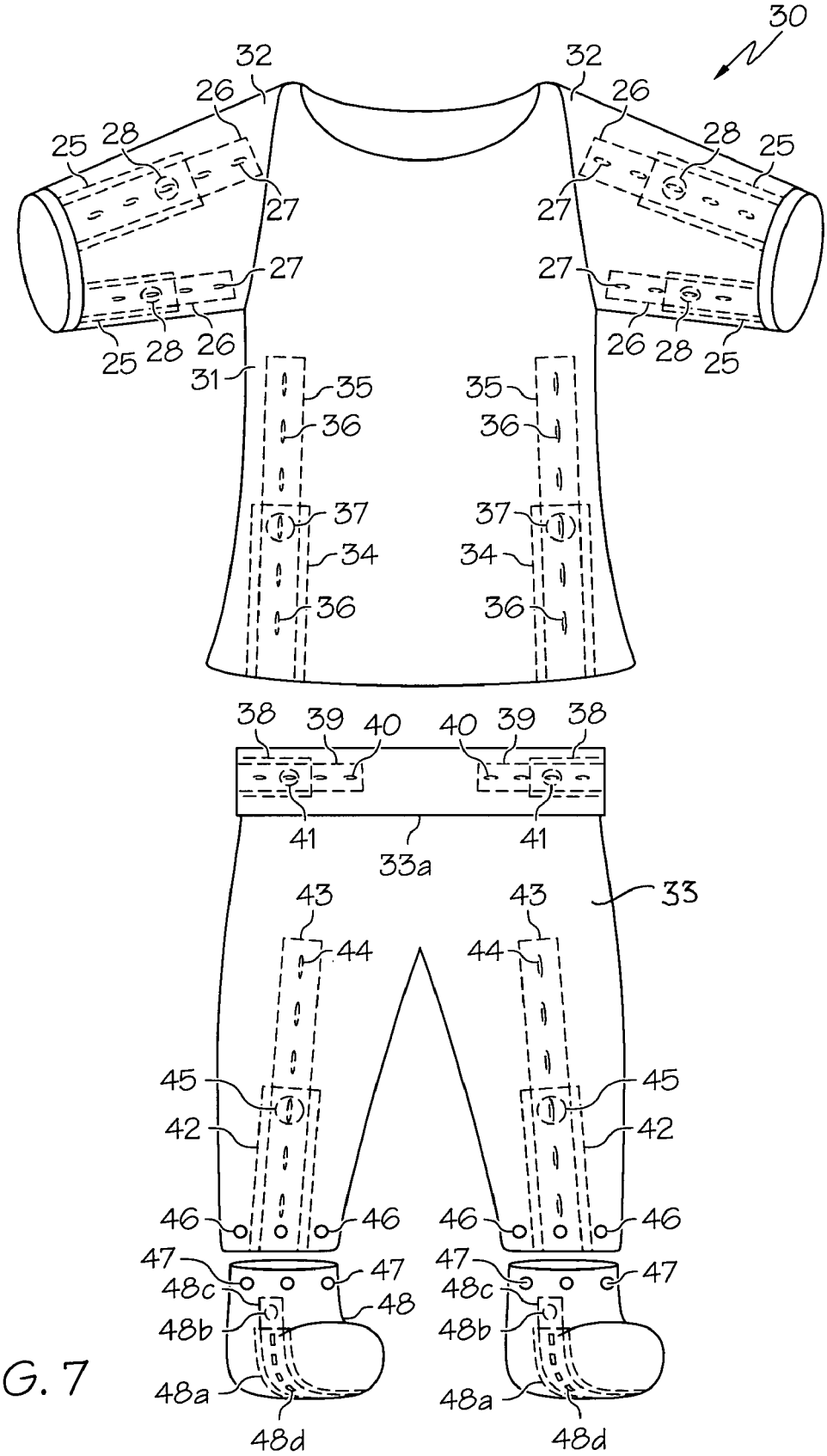
FIG. 7 is a perspective front view of a detached three-piece children garment with a foot or boot portion or bootie with an improved and unique adjustment feature having adjustable pockets and elastic band members according to a second preferred embodiment of the present invention.

Referring now to FIG. 7, which shows an illustration of a second embodiment of the preferred invention that includes a three-piece article of clothing or garment 30 with a unique and improved adjustment feature for increasing or decreasing the dimension of the three-piece article of clothing or garment 30 so that it may be worn by the same or several individuals or infants or children of varying size, length or height.

This three-piece article of clothing or garment 30 of the second embodiment includes a shirt body portion 31 with a pair of sleeves 32 with the same previous discussed first improved and unique adjustment features of the first preferred embodiment, a non-referenced upper neck entry opening defining a collar and a lower non-referenced body opening. The second piece of the article of clothing or garment 30 includes a pair of pant or trouser leg portions 33 with a plurality of the improved and unique adjustment features disposed thereon, a first plurality of spaced apart snap fasteners around the circumference of the lower opening of the pant or trouser leg portions 33 and a waist portion 33*a* with a plurality of the improved and unique adjustment features disposed thereon. The third piece of the article of clothing or garment 30 includes a pair of foot or boot portions or booties 48 with a second plurality of spaced apart snap fasteners around the circumference of the upper open foot entry of the pair of foot or boot portions or booties 48 that allows for attaching and detaching the snap fasteners on the leg portions 33 to and from the snap fasteners on the foot or boot portions or booties 48. This allows the three-piece garment 30 to become a two-piece garment without the foot or boot portions or booties 48, if desired.

In the second preferred embodiment, the unique and improved second adjustment feature is different than the second adjustment feature has been modified into multiple parts. The multiple parts include a second pair of pockets that are divided into first and second separate units. In the first separate unit, a pair of pockets 42 are sewn or attached along the front interior pant leg portions 33 extending between lower open ends of the pant leg portions 33 to desired spaced locations thereon. At or near the lower open ends of the pant leg portions, a plurality of spaced apart fasteners 46 is disposed about the circumference thereof. The pockets 42 of the first separate unit have lower closed ends that are sewn or attached at or adjacent the lower open ends of the pant leg portions 33, the opposite or upper open ends are sewn or attached at a selected distance to a desired location on the interior of the front pant leg portions 33. The second separate unit includes a pair of pockets 48*a* that are sewn or attached along a back inside portion along a heel section to a bottom foot section of the pair of foot or boot portions or booties 48 with a lower closed end extending to and being sewn or attached to or adjacent the toe portion of the foot or boot portions or booties 48. Optionally, the foot or boot portions or booties 48 in the second preferred embodiment could have at least a pair of improved adjustment feature being attached and positioned along each side of the foot or boot portions or booties 48 extending from or adjacent the toe portion to a spaced distance at or near the back or heel portion thereof in the same manner as described above, if desired.

Referring now to the waist section 33*a* of the pant or trouser leg portions 33 includes a unique and improved fourth adjustment feature thereon. This fourth adjustment feature includes at least a pair of spaced apart pockets 38 that are sewn or attached along an interior front portion of the waist section 33*a* with a lower closed end being secured at or adjacent to the inherent top side seams of the pant or trouser leg portions 33 and an upper open end being secured at a selected and spaced location on the interior front portion thereof. If desired, a second pair of adjustments pockets 38 can be disposed along the interior back portion of the waist section 33*a* (not shown) and secured in the same manner as the pair of pockets 38 disposed on the interior front portion of the waist section 33*a*. Optionally, a typical elastic or stretchable waist band could be utilized along the waist 33*a* of the second preferred embodiment of the present invention to replace the above fourth adjustment feature, that is well known in prior art, if desired.

The shirt body portion 31 of the three-piece garment of the second embodiment includes a fifth adjustment feature having at least a pair of spaced apart pockets 34 that are preferably sewn or attached along the inside side seams of the shirt body portion 31 and positioned at a selected and spaced distance along the interior side seams. Optionally, the at least a pair of spaced apart pockets 34 can be sewn or attached along the interior front portion of the shirt body portion 31 at or adjacent the inside side seams with a lower closed end being secured at or adjacent to the lower open end of the shirt body portion 31 and an upper open end of the pockets 34 extending to a selected and spaced distance along the interior front portion of the shirt body portion at or adjacent the inside side seams. Also, at least another pair of spaced apart pockets 34 (not shown) could be sewn or attached along the interior back portion of the shirt body portion at or adjacent the inside side seams (not shown) with a lower closed end being secured at or adjacent to the lower open end of the shirt body portion 31 and an upper open end extending to a selected and spaced distance along the interior back portion (not shown) of the shirt body portion 31 at or adjacent the inside side seams, if desired. The upper open end of the pockets 34 has a button member 37 attached to and adjacent the upper open ends of the pockets 34 opposite the lower sewn or attached ends.

The second pockets 42 and 48*a* of the second preferred embodiment as discussed above, further include adjustable elastic bands or stretchable members 43 and 48*c* with a plurality of space apart button holes 44 and 48*d* that selectively receives the button members 45 and 48*b* as the adjustable elastic band or stretchable members 43 and 48*c* are stretched to a desired button hole position for adjusting the article of clothing or garment 30 to accommodate various lengths and sizes of infants and children as they grow. The fourth pockets 38 of the second preferred embodiment as discussed above, further include adjustable elastic bands or stretchable members 39 with a plurality of space apart button holes 40 that selectively receives the button members 41 as the adjustable elastic band or stretchable members 39 are stretched to a desired button hole position for adjusting the article of clothing or garment 30 to accommodate various lengths and sizes of infants and children as they grow. The fifth pocket 34 of the second preferred embodiment as discussed above, further includes adjustable elastic bands or stretchable members 35 with a plurality of space apart button holes 36 that selectively receives the button members 37 as the adjustable elastic band or stretchable members 35 are stretched to a desired button hole position for adjusting the article of clothing or garment 30 to accommodate various lengths and sizes of infants and children as they grow.

An upper end of each of the elastic band or stretchable members 43 and 48*c*, 39 and 35 extends outwardly of the open ends of the second pockets 42, 48*a*, the fourth pockets 38 and the fifth pockets 34, with the lower ends of each of the elastic band or stretchable members 43 and 48*c*, 39 and 35 being sewn or attached to the inside of the lower closed ends of the plurality of pockets 42 and 48*a*, 38 and 34.

In operation, an adult, wearer or user can easily grasp the outward extended upper ends of the elastic band or stretchable members 43 and 48*c*, 39 and 35 to be selectively pulled and stretched out of the open ends of the plurality of pockets 42 and 48*a*, 38 and 34 to connect the desired button holes 44, 48*d*, 40 and 36 with the plurality of pocket button members 45, 48*b*, 41 and 37 to an adjusted position to accommodate dimensional changes of an infant, child or individual such as leg length, leg circumference, arm length, arm circumference or waistline circumference, while at the same time reducing or eliminating material gathering as the article of clothing or garment 30 is adjusted.

Figure 8:
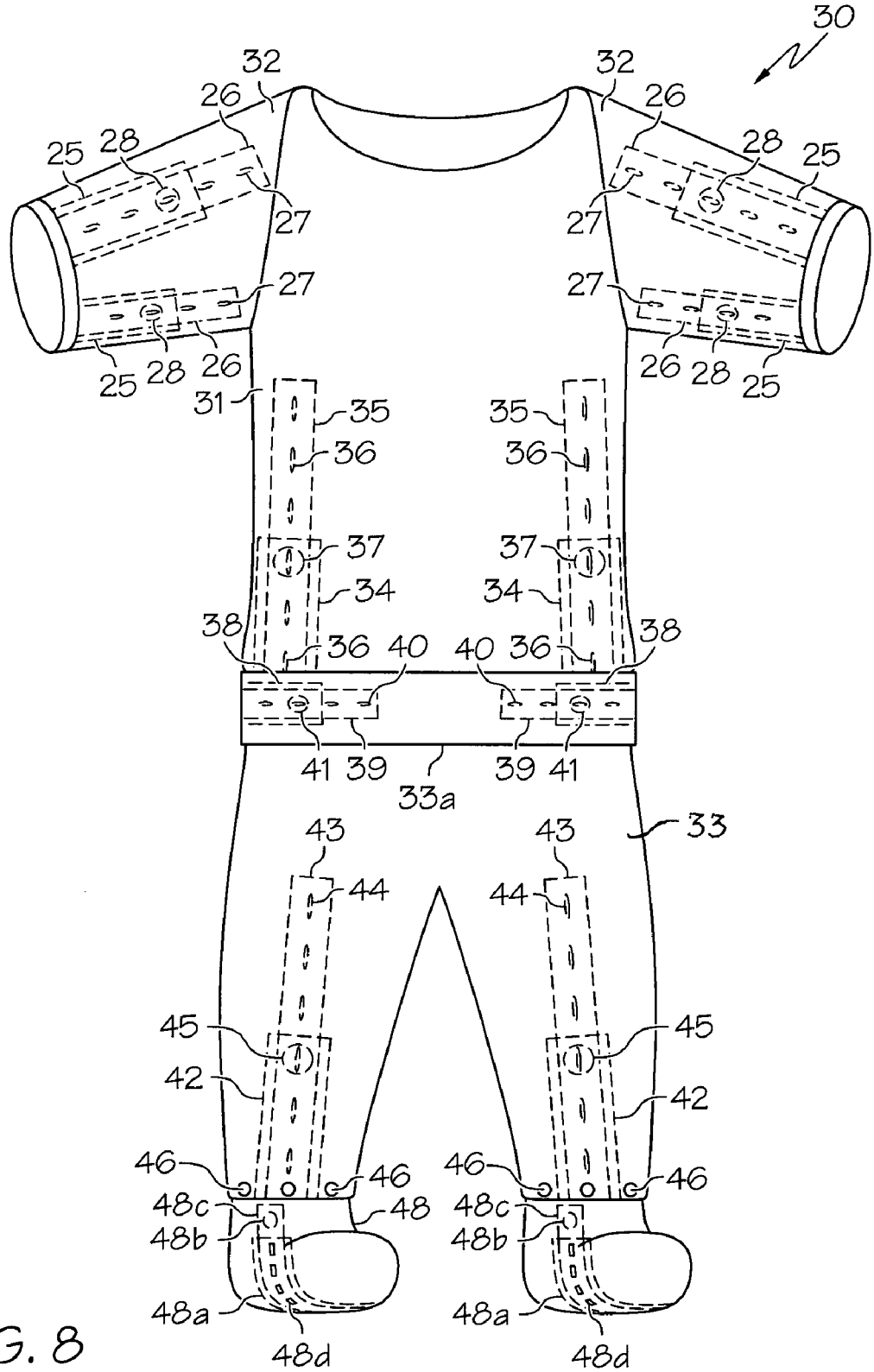
FIG. 8 is a perspective view front view of an attached three-piece children garment with a foot or boot portion or bootie with an improved and unique adjustment feature having adjustable pockets and elastic band members according to the second preferred embodiment of the present invention.

FIG. 8 of the second preferred embodiment shows the three-piece garment 30 in a full attached condition, while FIG. 7 shows the three-piece garment 30 in a detached condition. Therefore, since all elements of FIG. 7 and FIG. 8 are the same no further description is deemed necessary.

Figure 10:
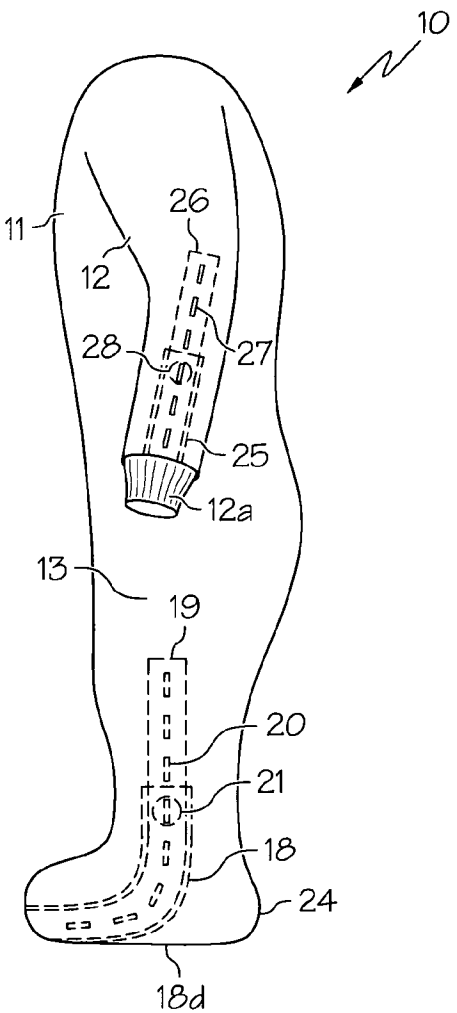
FIG. 10 is a side view of the improved and unique adjustable pockets and elastic band members disposed along a long sleeve portion and along a pant leg portion to or near the toe portion and along the bottom of the foot or boot or bootie according to the first and second preferred embodiments of the present invention.
Figure 9:
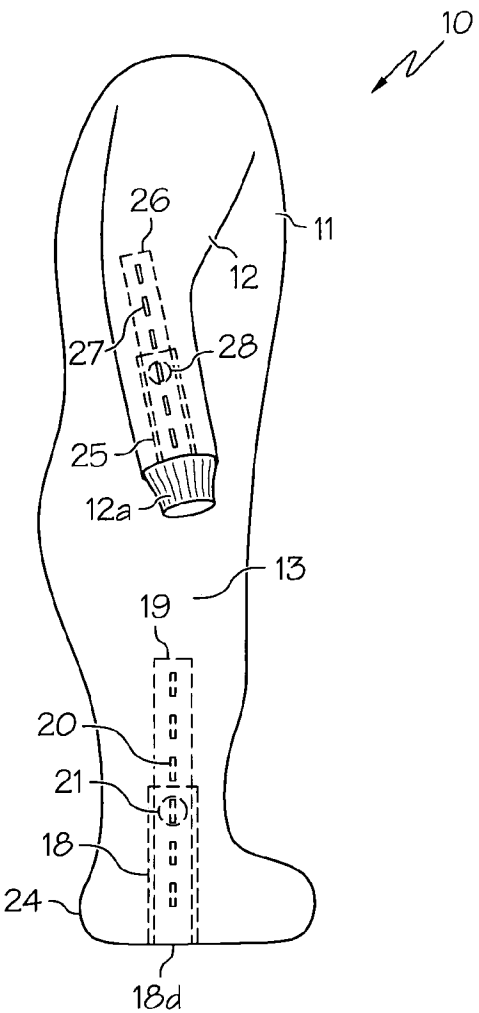
FIG. 9 is a side view of the improved and unique adjustable pockets and elastic band members disposed along a long sleeve portion and along a pant leg portion extending to a location at the bottom of the foot or boot or bootie according to the first and second preferred embodiments of the present invention.

FIGS. 9 and 10 illustrates reverse side profile views of the improved and unique adjustable pockets 25 and elastic band members 19 disposed along a long sleeve portion 12 and along a pant or trouser leg portion 13 extending to a location at or along the bottom 18*d* of the foot or boot or bootie 24 according to the first and second preferred embodiments of the present invention. In FIG. 9, the pocket 18 and the elastic band or stretchable member 19 are shown to be secured along the side or side seams of the pant or trouser leg portion 13 with the lower closed end being secured at or adjacent the bottom surface 18*d* of the foot or boot portion or bootie 24. FIG. 10 shown another arrangement, where the pocket 18 and the elastic band or stretchable member 19 is shown to be secured along the side or side seams of the pant or trouser leg portion 13 and along the bottom surface 18*d* of the foot or boot portion or bootie 24 with the lower closed end of the pocket and the elastic band or stretchable member 19 being secured at or adjacent the toe portion of the foot or boot portion or bootie 24. These arrangements allow for an easy adjustment of the article of clothing or garments 10 and 30 of the first and second preferred embodiments to accommodate physical dimensional changes of an infant, child or individual during their growth or development stages.

Also shown in FIGS. 9 and 10, the sleeve 12 can be a long sleeve with a cuff portion 12*a*. However, the sleeve 12 can be a short sleeve as illustrated in the previous discussed first and second preferred embodiments. Note that the adjustment pocket 25 and the elastic band or stretchable member 26 are shown to be secured along the interior of sleeve 12 with an upper open end being at a selected distance from a lower closed end attached at or adjacent the cuff 12*a*. The operation and details of the adjustment pocket 25 and the elastic band or stretchable member 26 will not be described, because they have been fully described in the operation and details of the adjustment features of the first and second preferred inventions.

Figure 11:
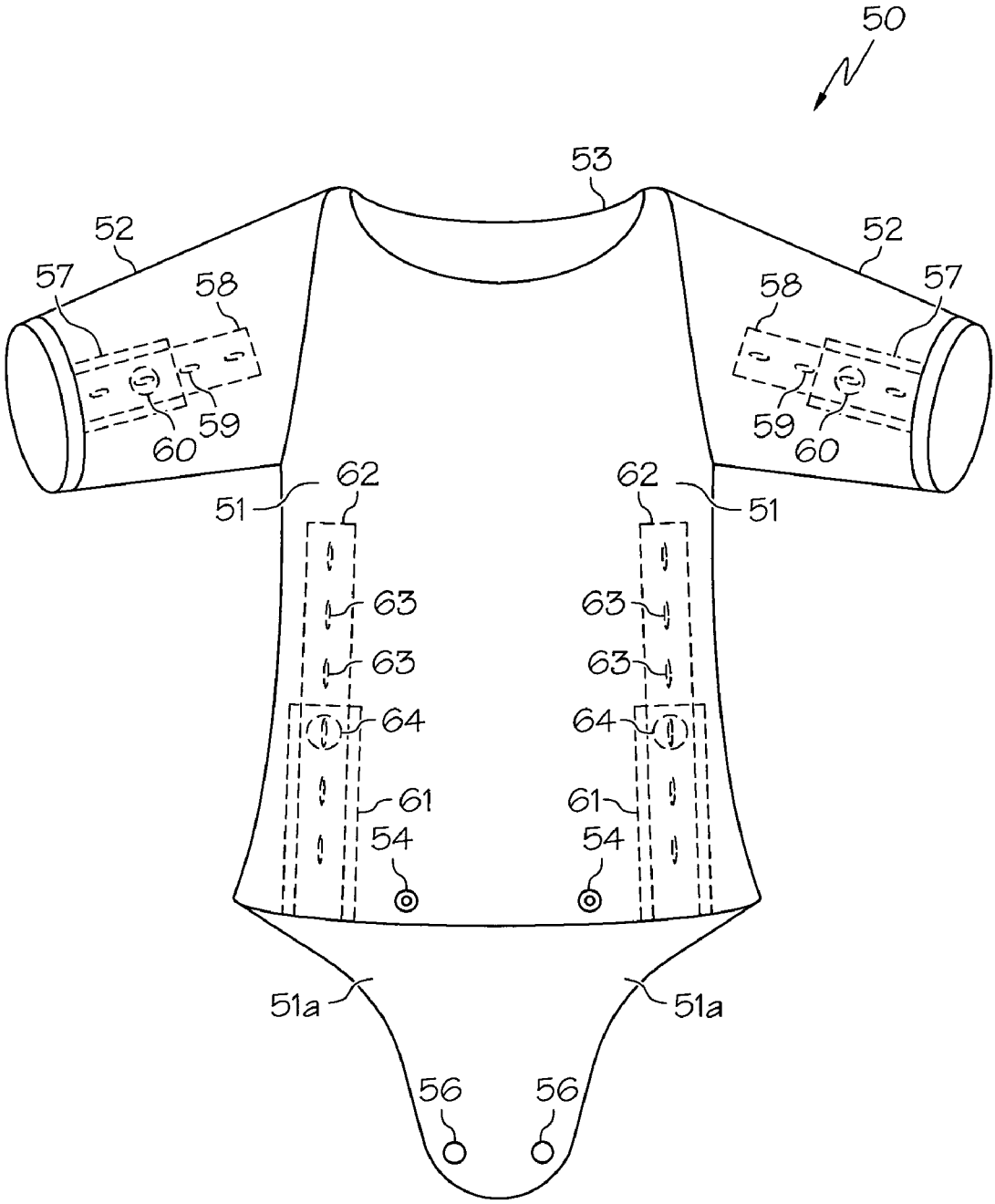
FIG. 11 is a perspective front view of a one-piece children garment with an extension or flap member extending from a back section beyond a front section defining a body entry opening with an improved and unique adjustment feature having adjustable pockets and elastic band members disposed on an upper body sleeve portion and along the side interior seam portions or along an inside front portion at or adjacent the interior side seams in accordance with a third preferred embodiment of the present invention.

FIG. 11 is a perspective front view of a one-piece children garment 50, such as a romper or a onesie outfit, with an extension or flap member 51*a* extending from a back section (not shown) beyond a front section 51 defining a body entry opening with an improved and unique adjustment feature having adjustable pockets 57 and 61 and elastic band members 58 and 61 disposed, respectively, on an upper body sleeve portion 52 and along the side interior seam portions or along an inside front portion at or adjacent the interior side seams in accordance with a third preferred embodiment of the present invention. A more detailed description will now be described:

The one piece garment 50 has a pair of short or long sleeves 52 (see FIGS. 9 and 10 above for the long sleeves), a shirt body 51 with a front section and a back section (not shown) and an extension or flap member 51*a* that extends from the back section beyond the front section defining an opening to receive the legs and crotch area of an infant or child. At the lower end of the front section at least a first pair of spaced apart fasteners 54 is disposed thereon and the extension or flap member 51*a* has at least a second pair of mating fasteners at a lower end thereof. When the first and second pairs of mating fasteners 56 are snapped together around the legs and crotch of the user or child, a pair of openings for the legs are formed and fit snugly and comfortably thereabout. This one-piece infant or children garment 50 includes the aforementioned improved and unique adjustment feature sewn or attached to the interior portion of the body portion 51, and the sleeves 52 for selectively adjusting and accommodating for the physical dimensions of infants and children during their development and growth stages.

The shirt body portion 51 with the pair of sleeves 52 of the one-piece garment of the third embodiment includes a sixth adjustment feature having at least a pair of spaced apart pockets 61 that are preferably sewn or attached along the inside side seams of the shirt body portion 51 and positioned at a selected and spaced distance along the interior side seams in the same manner as previously discussed in the second preferred embodiment. Optionally, the at least a pair of spaced apart pockets 61 could be sewn or attached along the interior front portion of the shirt body portion 51 at or adjacent the inside side seams with a lower closed end being secured at or adjacent to the lower open end of the shirt body portion and an upper open end extending to a selected and spaced distance along the interior front portion of the shirt body portion 51 at or adjacent the inside side seams as previously discussed. Also, at least another pair of spaced apart pockets 61 (not shown) could be sewn or attached along the interior back section of the shirt body portion 51 at or adjacent the inside side seams with a lower closed end being secured at or adjacent to the lower open end of the shirt body portion 51 and an upper open end extending to a selected and spaced distance along the interior back section of the shirt body portion 51 at or adjacent the inside side seams, if desired, in the same manner as previously discussed in the second preferred embodiment. The pockets 61 have a button member 64 attached to and adjacent the upper open ends of the pockets 61 opposite the lower sewn or attached ends.

Also, the plurality of pockets 61 further includes an adjustable elastic band or stretchable member 62 with a plurality of spaced apart button holes 63 that selectively receives the button members 64 as the adjustable elastic band or stretchable members 62 are stretched to a desired button hole position for adjusting the article of clothing or garment 50 to accommodate various lengths and sizes of infants and children as they grow. An upper end of the elastic band or stretchable members 62 extends outwardly of the pockets 61 open ends, with the lower end of the elastic band or stretchable members 62 being sewn or attached to the lower ends of the pockets 61.

In operation, the outward extending upper ends of the elastic band or stretchable members 62 can be easily grasped and selectively pulled and stretched out of the open ends of the plurality of pockets to connect the desired button holes 63 with the plurality of pocket button members 64 to reduce or eliminate material gathering as the article of clothing or garment 50 are adjusted to accommodate for infants or children growth or physical dimensional changes.

Figure 12:
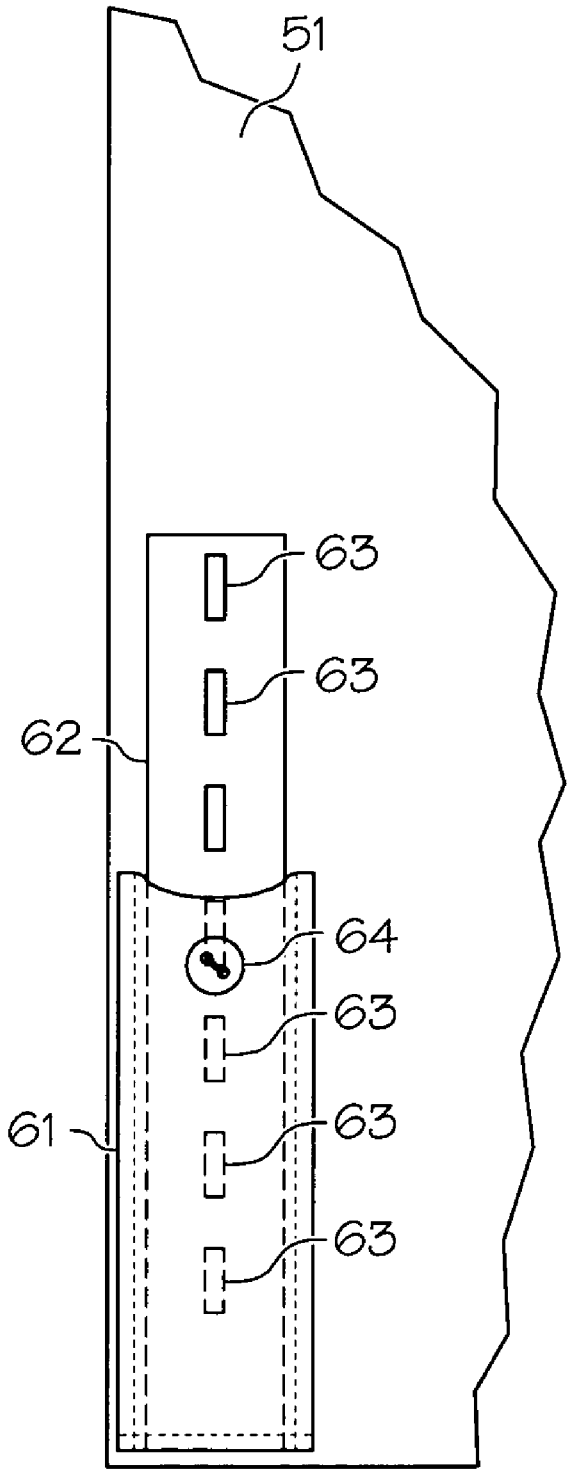
FIG. 12 is an inside out cut-out sectional side view of the improved and unique adjustable pockets and elastic band members disposed along the side interior seams or at or adjacent the interior side seams in accordance with the third preferred embodiment of the present invention.

FIG. 12 is an inside out cut-out sectional side view of the improved and unique adjustable pockets 61 and elastic band members 62 disposed and secured along the side interior seams or optionally disposed or secured at or adjacent the interior side seams along the inside front portion of shirt body portion 51 in accordance with the third preferred embodiment of the present invention. More detailed descriptions of this improved and unique adjustable pockets 61 and elastic band members 62 can be referred to the above descriptions as recited above for FIG. 11.

Figure 13:
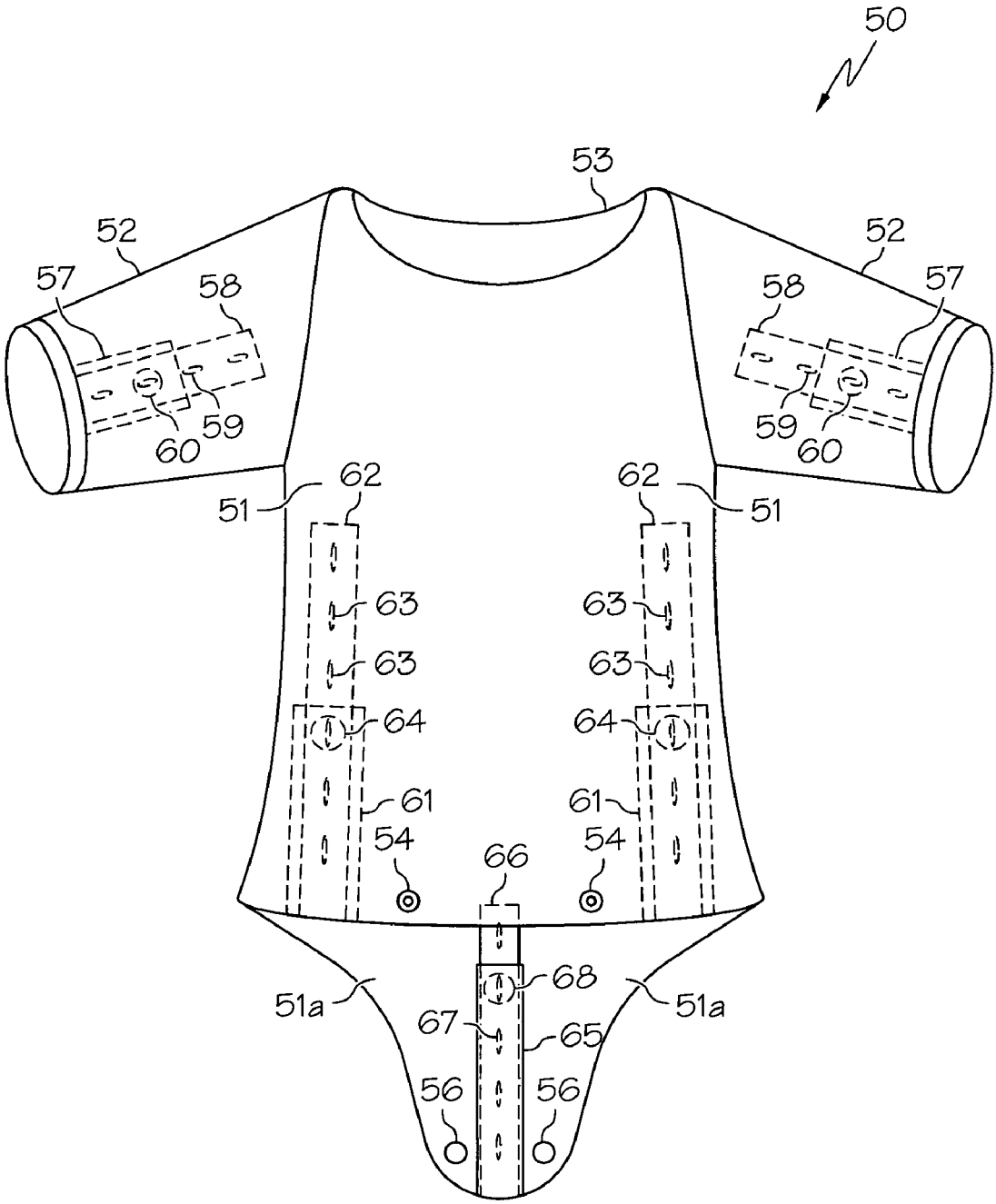
FIG. 13 is a perspective front view of the one-piece children garment with the extension or flap member extending from a back section beyond a front section defining a body entry opening with the improved and unique adjustment feature of FIG. 11 with an additional adjustable pocket and elastic band member disposed on the extension or flap member extending from a lower end thereof to a selected position thereon in accordance with the third preferred embodiment of the present invention.

FIG. 13 represents a perspective front view of the one-piece children garment 50 with the extension or flap member 51*a* extending from a back section beyond a front section defining a body entry opening with the improved and unique adjustment feature as illustrated in FIG. 11, with an additional adjustable pocket 65 and elastic band or stretchable member 66 disposed on the extension or flap member 51*a* extending from a lower end thereof to a selected position thereon in accordance with the third preferred embodiment of the present invention. This option permits the front of the extension or flap member 51*a* to include the additional pocket 65 and elastic band or stretchable member 66 with its lower closed end attached at or adjacent the fasteners 56 thereon and the upper open end being attached at a spaced and selected distance along the extension or flap member 51*a*, if desired. This additional pocket 65 and elastic band or stretchable member 66 allows the extension or flap member 51*a* to be adjusted to accommodate physical dimensional changes in infants or children. There is no need to further describe how the adjustable pocket 65 and elastic band or stretchable member 66 works, because its operation is the same as all the other above described adjustable pockets and elastic band or stretchable members of the first, second and third preferred embodiments.

In conclusion, the foregoing descriptions of the preferred embodiments of FIGS. 1-13 of the present invention have been presented for purposes of illustration and clarity. Note that the aforementioned unique and improved adjustable feature for article of clothing has many advantages. One advantage is that the unique and improved adjustable feature can easily be mounted on any type of clothing or garment as discussed earlier. A second advantage is that the unique and improved adjustable feature allows article of clothing or garments to be expanded and utilized for longer period of time. This unique and improved adjustable feature reduces clothing cost, clothing storage space and overcrowded wardrobes. Another advantage is that the unique and improved adjustable feature provides a universal clothing mechanism for easy adjustment to accommodate physical dimensional changes in infants, children and adults.

Even though it is not illustrated in the preferred embodiments of the present invention, the long sleeves of the article of clothing or garment could have rolled up or turned back cuffs thereon that can be pulled over infants or children hands to prevent scratching, if desired. Note that the rolled up or turned back cuffs could be detachable glove-like members with detachable fasteners thereon to mate with complimentary fasteners disposed at or adjacent the end of the sleeves or the cuffs of the sleeves. The fasteners can take on many various types that may be used to conveniently attach and detach sections of clothing from each other as mentioned earlier.

Also, it should be understood that that many other uses will be found for the instant invention disclosure and many alterations, modifications, and substitutions may be made thereto without departing from the spirit and scope of the invention as defined by the appended claims. Such are intended to be included within the scope of the invention. Accordingly, the scope of the invention should be determined not by the embodiments illustrated, but by the appended claims and their legal equivalents.

What is claimed is:

1. An adjustable garment comprising:

an article of clothing having a shirt body portion, a pair of sleeves with arm exit openings, an associated extended body member defining a pair of leg portions and a foot or bootie portion in cooperation with the leg portions;

a unique adjustment feature, the adjustment feature including;

a first plurality of spaced apart adjustment elements selectively disposed and secured along interior portions of the pair of sleeves, the first spaced apart adjustment elements defining at least a pair of spaced apart pocket members with closed lower ends attached at or adjacent the exit openings of the sleeves and upper open ends attached at a spaced and selected distance from the exit openings, the upper open ends having a button fastener adjacent thereto, a first elastic band member having a first end secured inside each of the spaced apart pocket members at the closed lower ends thereof and a second end extending at a selected distance beyond the upper open ends of the spaced apart pockets, the first elastic band members have a plurality of button fastener holes disposed therein; and a second plurality of spaced apart adjustment elements selectively disposed and secured along interior portions of the pair of leg portions and along interior portions of the foot or bootie portions, the second plurality of spaced apart adjustment elements defining at least a pair of second pocket members with closed lower ends attached at or adjacent a toe section of the foot or bootie portions and upper open ends attached at spaced and selected positions along the interior of the leg portions, the upper open ends having a button fastener adjacent thereto, a second elastic band member having first end secured inside each of the second pocket members at the closed lower ends thereof and a second end extending at a selected distance beyond the upper open ends of the second pocket members, each of the second elastic band members has a plurality of button holes disposed therein, whereby, the adjustment of the article of clothing is achieved when the second ends of the first and second elastic band members are grasped and selectively pulled and stretched out of the open ends of the plurality of pocket members to connect any desired button holes with the plurality of pocket button fasteners to accommodate for physical dimensional changes of children during their growth and development stages, while reducing or eliminating material gathering as the article of clothing is adjusted.

2. The adjustable garment according to claim 1, wherein the article of clothing comprise children garments selected from a group consisting of rompers, sleepers, one-piece outfits, multiple piece outfits, shirts, blouses, dresses, pants or trousers, vests, coats, jackets, gowns or other types of children clothing or garments.

3. The adjustable garment according to claim 1, wherein the button fasteners and button fastener holes comprise fasteners selected from a group consisting of zippers, hook-and-loop type materials, metallic or plastic snaps, magnets, or any other types of fasteners or mechanism that may be used to conveniently adjust an article of clothing.

4. The adjustable garment according to claim 1, wherein the first plurality of spaced apart adjustment elements includes at least three spaced apart pocket members and elastic band members disposed on the pair of sleeves.

5. The adjustable garment according to claim 1, wherein the second plurality of spaced apart adjustment elements includes at least three spaced apart pocket members and elastic band members disposed along an interior front portion of the leg portions and along an upper interior surface of the foot or bootie portions, along an interior back portion of the leg portions and along a heel section and a bottom surface of the foot or bootie portion, and disposed along at least one interior side along the seams and extending down one side of the foot or boot portions at or adjacent to a bottom surface thereof.

6. The adjustable garment according to claim 1, wherein the article of clothing further includes a collar portion defining a wearer or user entry opening with a first parting section with a first plurality of snap type fasteners and a second parting section with a second plurality of mating fasteners thereon, extending from the collar to a selected location on the front of the upper shirt body portion that allows the adjustable garment to be placed easily over the head of a user or wearer so that it can be worn, and the leg portions includes a pair of entry parting sections extending from a crotch area of the adjustable garment down the leg portions to the foot or bootie portion with a plurality of snap fasteners on each entry parting sections for mating engagement with one another for easy access in putting on and taking off the adjustable garment.

7. A unique adjustment feature for an article of clothing having a shirt body portion, a pair of sleeves with arm exit openings extending from the shirt body portion, an associated pant section having a pair of leg portions and a foot or bootie portion in cooperation with the leg portions, the unique adjustment feature comprising;

a first plurality of spaced apart adjustment elements disposed and secured along the interior of the pair of sleeves, each of the first spaced apart adjustment elements defining a pocket member with a closed lower end attached at or adjacent the exit openings of the sleeves and an upper open end attached at a spaced and selected distance from the exit openings, the upper open end having a button fastener adjacent thereto, an elastic band member having a first end secured inside the pocket member at the closed lower end of the pocket member and a second end extending at a selected distance beyond the upper open end of the pocket member, the elastic band member has a plurality of button fastener holes disposed therein; and a second plurality of spaced apart adjustment elements disposed and secured along the interior of each of the pair of leg portions and along the interior of the foot or bootie portion, each of the second spaced apart adjustment elements including at least a pocket member with a closed lower end and an upper open end with a button fastener attached thereto, at least an elastic band member having a first end secured inside the at least a pocket member at the closed lower end of the at least a pocket and a second end extending at a selected distance beyond the upper open end of the at least a pocket, the at least an elastic band member has a plurality of button holes therein, whereby, the adjustment of the article of clothing is achieved simply by grasping the second ends of the elastic bands and selectively pulling and stretching the second ends outwardly of the open ends of the plurality of pocket members to connect any desired button holes with the plurality of pocket button fasteners to accommodate for physical dimensional changes of an infant, child or individual, such as, leg length, leg circumference, arm length, arm circumference or waistline circumference during the development or growth stages of the infant, child or individual as the article of clothing is adjusted, while at the same time, reducing or eliminating material gathering and maintaining the integrity of the article of clothing.

8. The unique adjustment feature according to claim 7, wherein the second plurality of spaced apart adjustment elements includes at least a pair of separate spaced pocket and elastic band members disposed on each of the front and back leg portions.

9. The unique adjustment feature according to claim 7, wherein the second plurality of spaced apart adjustment elements further includes at least a pair of separate spaced pocket and elastic band members disposed on each of the foot or bootie portions.

10. The improved and unique adjustment feature according to claim 7, wherein the second plurality of spaced apart adjustment elements includes at least a pair of separate spaced apart pocket members having a lower end attached at or adjacent each of the lower open ends of the pant leg portions, each of the upper open ends of the at least a pair of separate spaced apart pocket members are attached along an interior portion of front and back pant leg portions to a selected and spaced location thereon, at least a pair of separate spaced elastic band members having an upper end extending outwardly of the open ends of each of the at least a pair of spaced apart pockets with the lower ends of each of the at least a pair of separate spaced elastic band members being attached to the inside of the lower closed ends of each of the at least a pair of the separate pocket members.

11. The unique adjustment feature according to claim 7, wherein the second plurality of spaced apart adjustment elements includes at least a pair of separate spaced apart pocket members having a lower end attached at or adjacent each toe portion of the foot or bootie portions, each of the upper open ends of the at least a pair of separate spaced apart pocket members are attached at or adjacent a foot entry of the foot or bootie portions, with an intermediate section attached along a back interior heel section and an interior bottom foot surface of the foot or bootie portions, at least a pair of separate spaced apart elastic band members having an upper end extending outwardly of the open ends of each of the at least a pair of separate spaced apart pockets with the lower ends of each of the at least a pair of separate spaced elastic band members being attached to the inside of the lower closed ends of each of the at least a pair of the separate spaced pocket members of the foot or bootie portions.

12. The unique adjustment feature according to claim 7, wherein the pant leg portions includes a plurality of fastener elements disposed about the circumference of a lower end thereof, the upper end of the foot or bootie portions has a plurality of mating fastener elements for removably attaching the pant leg portions and the foot or bootie portions as a unit.

13. The unique adjustment feature according to claim 7, wherein a third plurality of at least a pair of spaced apart pocket members being attached along an interior front and back portions of the waist section with a lower closed end being secured at or adjacent to opposite interior side seams of a waist section of the pant leg portions and an upper open end with a button fastener adjacent thereto, and being secured at a selected and spaced location on the interior front and back portions thereof, each of the third plurality of the least a pair of spaced apart pocket members having an elastic band member with a lower end and an upper open end, each of the elastic band members lower ends being secured in the interior of each of the third plurality of the least a pair of spaced apart pocket members at the lower closed ends, each of the upper ends of the elastic band members being secured at a spaced and selected location along the front and back portions of the waist section, each of the elastic band members having a plurality of mating fastener holes thereon for selective adjustment engagement with the button fasteners to contract or expand the waist section.

14. The unique adjustment feature according to claim 7, wherein a fourth plurality of at least a pair of spaced apart pocket members attached along an interior front and back portions of the shirt body portion with a lower closed end being secured at or adjacent to interior side seams of the shirt body portion and an upper open end with a button fastener adjacent thereto, and being secured at a selected and spaced location on the interior front and back portions thereof, each of the fourth plurality of the least a pair of spaced apart pocket members having an elastic band member with a lower end and an upper open end, the elastic band member lower end being secured in the interior of each of the fourth plurality of the least a pair of spaced apart pocket at the lower closed end, each of the upper ends of the elastic band members being secured at a spaced and selected location along the front and back portions of the shirt body portion, each of the elastic band members having a plurality of mating fastener holes thereon for selective adjustment engagement with the button fasteners to contract or expand the shirt body portion.

15. The unique adjustment feature according to claim 7, wherein the button fasteners and button fastener holes comprise fasteners selected from a group consisting of zippers, hook-and-loop type materials (e.g. Velcro), metallic or plastic snaps, magnets, or any other types of fasteners or mechanism that may be used to conveniently with an article of clothing.

16. The unique adjustment feature according to claim 12, wherein the snap fasteners on the circumference of the lower pant leg portions and the mating fasteners on the circumference of the upper foot entry ends comprise fasteners selected from a group consisting of zippers, hook-and-loop type materials, metallic or plastic snaps, magnets, or any other types of fasteners or mechanism that may be used to conveniently adjust and removably attach sections of an article of clothing.

17. An article of clothing in combination with a unique adjustment feature, the combination comprising:

a clothing garment having a shirt body portion, a pair of sleeves with arm exit openings, an upper collar and neck opening, a lower body exit opening and an associated extended body member defining a pair of leg portions;

the unique adjustment feature including;

a first plurality of spaced apart adjustment elements disposed and secured along the interior of the pair of sleeves, the first spaced apart adjustment elements defining at least a pair of spaced apart pocket members with closed lower ends attached at or adjacent the exit openings of the sleeves and upper open ends attached at a spaced and selected distance from the exit openings, the upper open ends having a button fastener adjacent thereto, at least a pair of elastic band members having a first end secured inside the spaced apart pocket members at the closed lower ends thereof and a second end extending at a selected distance beyond the upper open ends of the spaced apart pockets, the at least a pair of spaced apart elastic band members have a plurality of button fastener holes disposed therein; and a second plurality of spaced apart adjustment elements disposed and secured along both of the interior side seams of the shirt body portion, the second plurality of spaced apart adjustment elements defining at least a pair pocket members with closed lower ends attached along the interior side seams at or adjacent the lower body exit opening of the shirt body portion and upper open ends attached at a spaced and selected position along the interior side seams from the lower body exit opening, the upper open ends of the at least a pair of pocket members having a button fastener adjacent thereto, at least a pair of elastic band members having a first end secured inside each of the at least a pair of pocket members at the closed lower ends of the at least a pair of pocket members and second ends extending at a selected distance beyond the upper open ends of the at least a pair of pocket members, each of the at least a pair of elastic band members have a plurality of button holes disposed therein, whereby, the adjustment of the article of clothing is achieved when the second ends of the elastic bands are grasped and selectively pulled and stretched out of the open ends of the plurality of pocket members to connect any desired button holes with the plurality of pocket button fasteners to accommodate for physical dimensional changes in children during their growth and development stages, while simultaneously reducing or eliminating material gathering of the garment as it is being adjusted.

18. The combination according to claim 17, wherein a first plurality of spaced apart fastening members are disposed on the shirt body portion at or adjacent the lower body exit opening, a second plurality of spaced apart fastening members disposed at a lower end of the associated extended body member, the second fastening members are operable associated with the first fastening members for removably attaching and detaching the associated extended body member and the shirt body portion for allowing the leg portions to be formed about a crotch area of a user when the fasteners are in engagement with one another and opening the leg portions when the fasteners are disengaged from one another to gain easy access to specific body portions of the user.

19. The combination according to claim 18, wherein a pocket element is attached along an inner portion of the associated extended body member with a lower closed end being secured at or adjacent to the second plurality of fasteners at the lower end of the associated extended member and an upper open end with a button fastener adjacent thereto, and being secured at a selected and spaced location on the inner portion of the associated extended body member thereof, the pocket element has an elastic band member with a lower end and an upper open end, the elastic band member lower end being secured in the interior of pocket element at the lower closed end, the upper open end of the elastic band member being secured at a spaced and selected location on the associated extended body member, the elastic band member have a plurality of mating fastener holes disposed thereon for selective adjustment engagement with any one of the button fastener holes to contract or expand the clothing garment to accommodate for growth and physical dimensional changes in infants and children.

20. The combination according to claim 17, wherein the first and second plurality of fasteners, the button fasteners and the button fastener holes comprise fasteners selected from a group consisting of buttons, zippers, hook-and-loop type materials, metallic or plastic snaps, magnets, or any other types of fasteners or mechanism that may be used to selectively adjust the clothing garment to accommodate for growth and physical dimensional changes in infants and children.

* * * * *